United States Patent [19]

Ducorday

[11] Patent Number: 4,886,299

[45] Date of Patent: Dec. 12, 1989

[54] BOOK COVER

[76] Inventor: Gerard M. Ducorday, 10871 Thorley Rd., Santa Ana, Calif. 92705

[21] Appl. No.: 293,753

[22] Filed: Jan. 3, 1989

[51] Int. Cl.[4] ..... B42D 3/00

[52] U.S. Cl. ..... 281/31; 156/251; 412/3; 283/64; 281/34; 281/35

[58] Field of Search ..... 412/3; 281/20, 31, 29, 281/35, 34; 283/64; 428/13, 124; 156/251, 152, 156, 264, 74, 72; 229/73; 206/472, 473

[56] References Cited

U.S. PATENT DOCUMENTS

| | | | |
|---|---|---|---|
| 140,275 | 6/1873 | Jocelyn . | |
| 2,641,484 | 6/1953 | Brody | 281/34 |
| 3,133,750 | 5/1964 | Gerald | 281/34 |
| 3,367,680 | 2/1968 | Greenspan | 281/37 |
| 3,572,767 | 3/1971 | Learned | 281/34 |
| 3,833,244 | 9/1974 | Heimann | 281/21 |
| 3,891,240 | 6/1975 | DuCorday | 281/29 |
| 3,904,227 | 9/1975 | Sendor | 281/29 |
| 3,953,056 | 4/1976 | Roberts | 281/29 |
| 4,111,460 | 9/1978 | Roberts | 281/29 |
| 4,139,216 | 2/1979 | Saint Clair | 281/4 |
| 4,147,380 | 4/1979 | Nelson | 281/29 |
| 4,156,538 | 5/1979 | Roberts | 281/29 |
| 4,204,704 | 5/1980 | Staats | 281/21 |
| 4,209,187 | 6/1980 | Forrest | 281/19 |
| 4,266,812 | 5/1981 | Staats | 281/29 |
| 4,274,659 | 6/1981 | D'Ambrosio | 281/34 |
| 4,280,241 | 7/1981 | Pfaff | 11/1 |
| 4,355,822 | 10/1982 | McHugh | 281/34 |
| 4,371,195 | 2/1983 | Wang et al. | 281/21 |
| 4,497,508 | 2/1985 | McHugh | 281/34 |
| 4,527,814 | 7/1985 | Carter et al. | 281/31 |
| 4,605,245 | 8/1986 | Weaver | 281/34 |
| 4,715,619 | 12/1987 | Sloot | 281/19 |
| 4,744,592 | 5/1988 | Barnette et al. | 281/15 |

FOREIGN PATENT DOCUMENTS 2075915 11/1981 United Kingdom .

*Primary Examiner*—Paul A. Bell
*Assistant Examiner*—Thomas Hamill, Jr.
*Attorney, Agent, or Firm*—Poms, Smith, Lande & Rose

[57] ABSTRACT

A protective book cover of transparent plastic is formed with a strengthened spine section provided by a combination of a spine reinforcing strip and decreased height of the spine section of the protective cover. The book cover receiving pockets of the protective cover are formed with inwardly convex slant-cut edges to facilitate insertion of the book covers, and a card pocket is formed in one of the pockets by a slant-cut slit that is convex upwardly to provide an easily accessible opening. A heat weld seam forming the front and back cover pockets is provided with sharp rectangular inside corners for a closer fit of the protective cover to the book. The protective cover is adjustable for book width by forming it of a primary or outside panel that is scored for separation of a back cover portion which may be adjustably positioned and adhesively secured to a front cover portion.

26 Claims, 3 Drawing Sheets

FIG. 3.
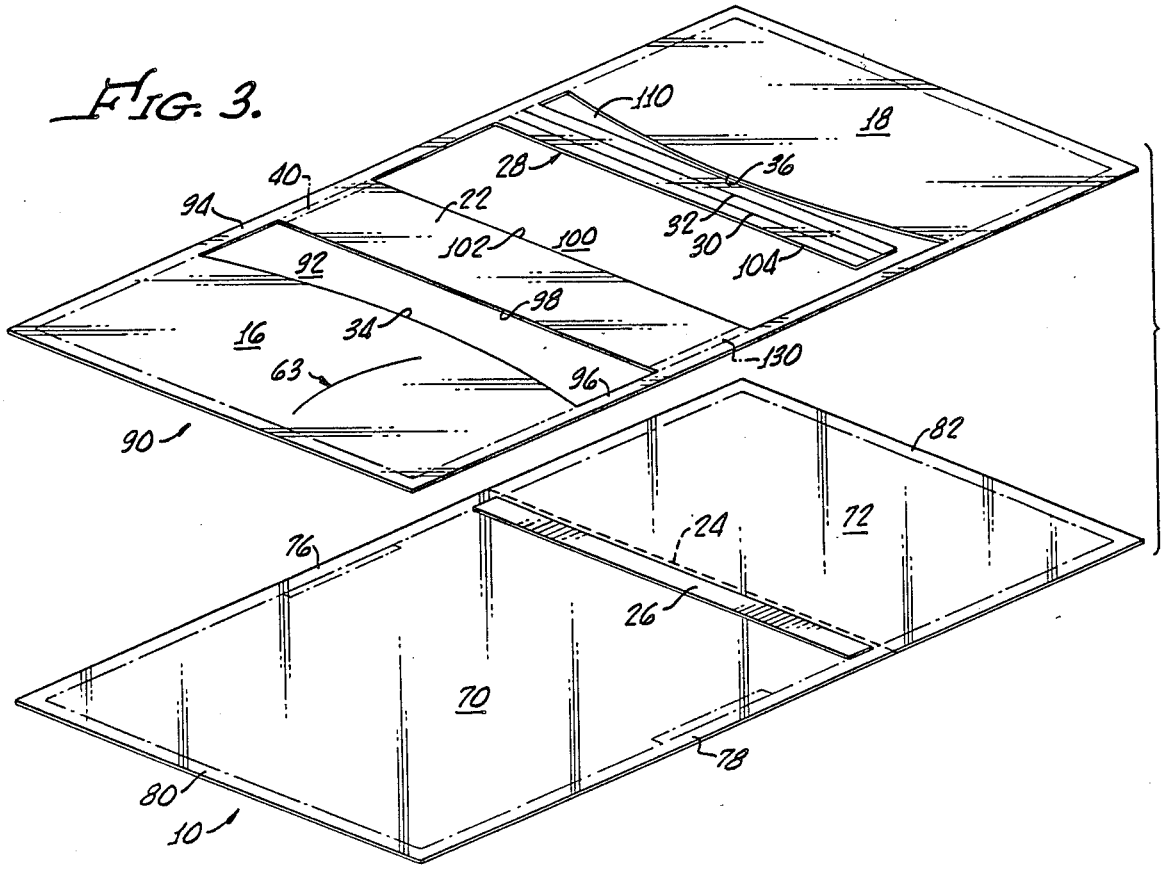
FIG. 2.
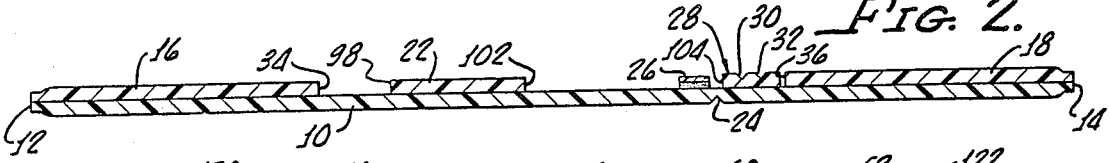
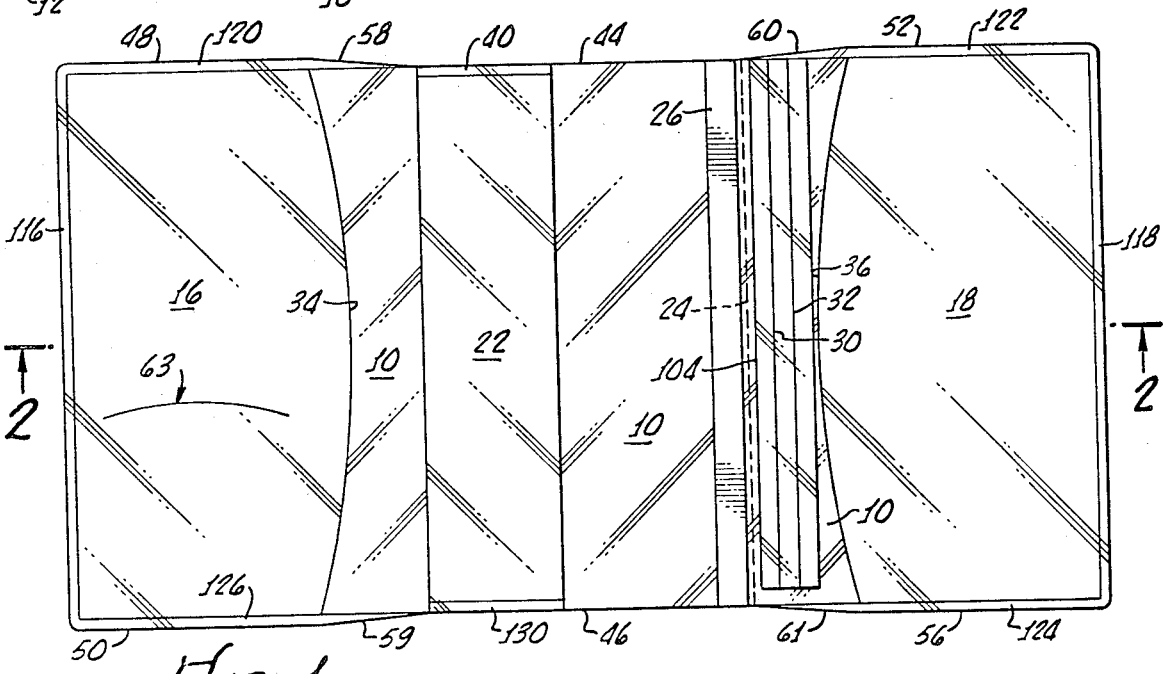
FIG. 1.

FIG. 4.
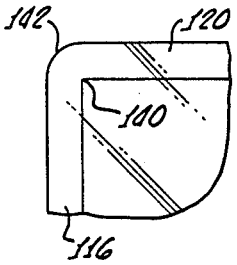
FIG. 5.
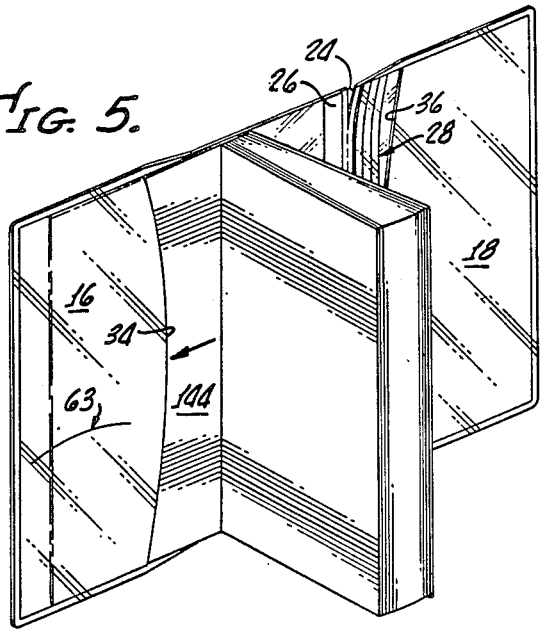
FIG. 6.
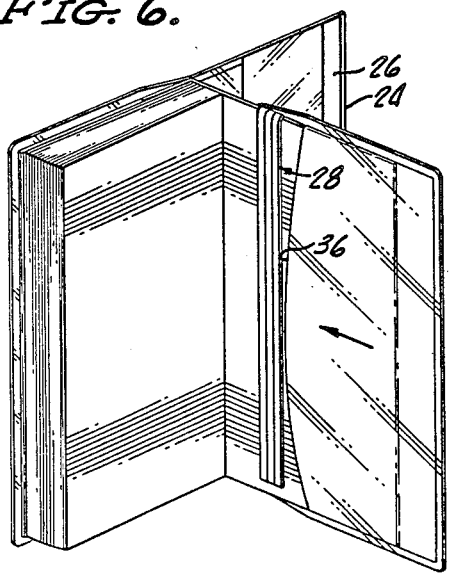
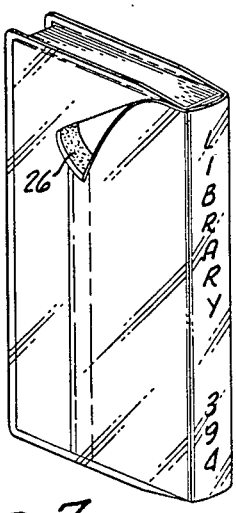
FIG. 7.
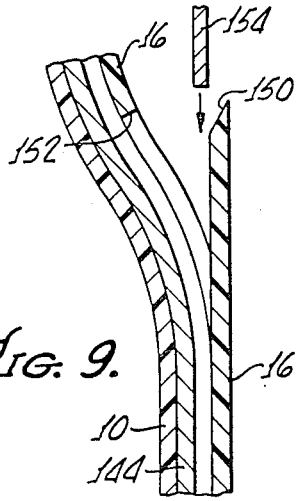
FIG. 8.
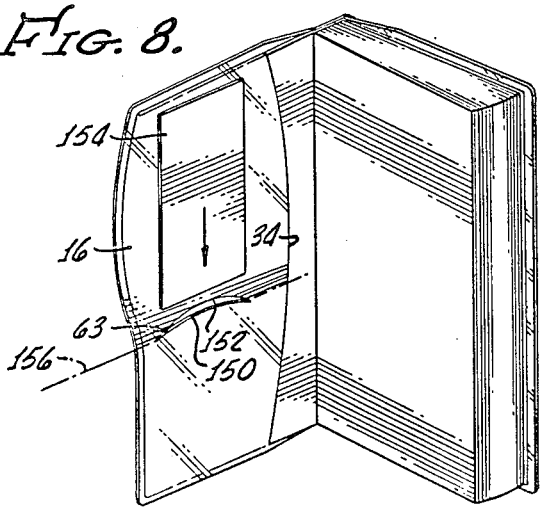
FIG. 9.

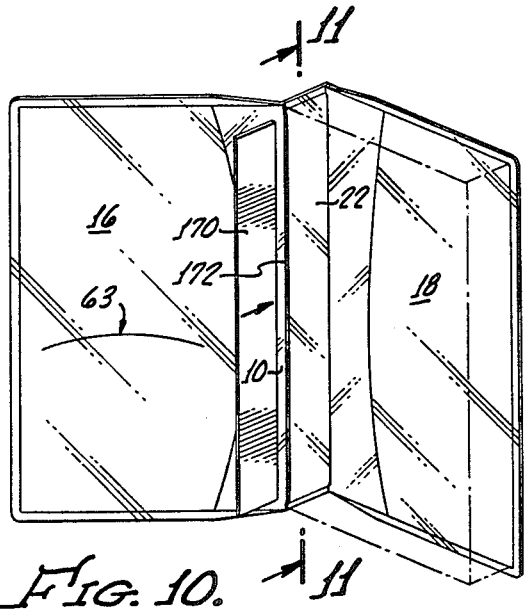
FIG. 10.
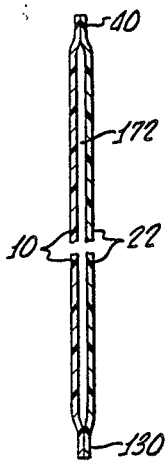
FIG. 11.
FIG. 12.
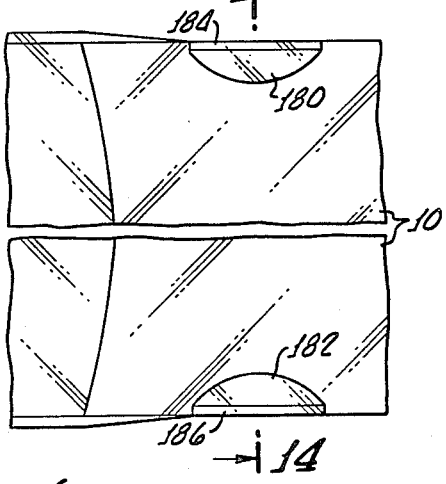
FIG. 13.
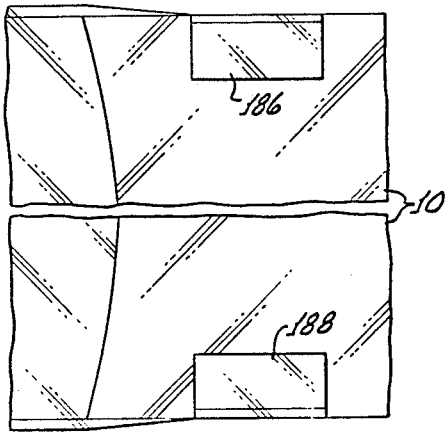
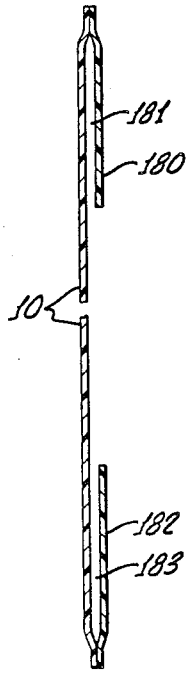
FIG. 14.

BOOK COVER

BACKGROUND OF THE INVENTION

The present invention relates to methods and apparatus for protection of books, and more particularly concerns simple, inexpensive and effective protection of books by means of a protector sheet having a number of improved features.

DESCRIPTION OF PRIOR ART

Books that are subject to wide use and frequent handling are commonly provided with protectors that extend around the exterior of the book covers and around the spine of the book. Such protectors commonly include front and back cover receiving pockets and a body portion extending over the outer face of the covers and over the spine of the book. A protective cover of this type, that is adjustable to accommodate books of varying thicknesses, is described in my prior patent for Book Cover, No. 3,891,240. This cover, as many other prior art covers, is formed of a rectangular sheet having book cover receiving pocket panels heat welded to end portions by weld seams extending along the cover sheet edges. The weld seam has a portion extending both above and below the pockets by at least the width of the seam, and thus the area of the cover sheet adjacent the spine, intermediate the cover receiving pockets, which is not welded to any pocket panels, extends above and below the upper and lower edges of the spine of the book received in the protective cover. In removing a book from a shelf and replacing the book on the shelf, the upper and lower corners of the spine of the book, or of the spine portion of the protective cover if the book has one, are subject to greatest forces and maximum wear. Generally a book is removed from the shelf by a reader who places a finger on the top back portion of the spine and pulls this top back portion to tilt the top of the book outwardly so that the body of the book may be grasped between the fingers. This mode of tilting the book outwardly from a position on a book shelf places maximum force on that portion of the protective cove that extends upwardly above the book spine, and, therefore, such portion tends to become frayed and torn with use. Again, because of the tilting action that is involved in both removal of a book from a shelf and the replacement of a book on the shelf (often by first tilting the book with the front facing upwardly so that the bottom rear portion of the spine first makes contact with the shelf), that portion of the book cover extending below the bottom of the book spine is also subject to increased forces and increased wear, tending to bend, fray and tear this portion of the book cover also. These forces on the upper and lower rear edges of the book cover not only tend to fray the edges, but also tend to compress and bend the entire spine portion of the cover, further decreasing cover life.

The welded seam providing the front and back pockets for the covers of the book that are received in the protective sheet are rounded in the prior art. Typical of such rounded cover corners are the sealed rounded corners shown in FIG. 10 of the patent to Learned, No. 3,572,767. With the rounded corner, the pocket must be made significantly larger than the cover of the book that is received in the pocket, because the covers themselves generally have sharp, square corners. Therefore, the protective cover inherently is unable to closely fit the book that it covers.

Protective book covers of the prior art, further, have not provided pocket or card receiving holders for holding such items as a library card, for example, and have not facilitated additional identification of the book by readily attachable and removable labels.

Accordingly, it is an object of the present invention to provide a protective book cover that avoids or minimizes above mentioned problems.

SUMMARY OF THE INVENTION

In carrying out principles of the present invention in accordance with a preferred embodiment thereof, a book protective cover for removable attachment to and detachment from a book is provided by an outside panel having a front cover portion, a back cover portion, and an intermediate spine portion, with front and back pocket panels secured thereto for receiving front and back covers of a book. Spine strengthening means for the protective cover are provided by reinforcing means secured to upper and lower portions of the spine, or by reducing the height of the spine to a height substantially equal to the height of the book to be protected, or by a combination of both spine strengthening arrangements. According to a feature of the invention the front and back pocket panels are secured to the outside panel by weld seams that are specifically formed with sharp right angle inside corner boundaries, but nevertheless, have rounded outside boundaries for ease of handling and to avoid sharp, uncomfortable or hazardous corners. According to still another feature of the invention, card or indicia holding pockets are formed by providing an upwardly convex slit in one or both of the pocket panels to provide an easy opening mouth for a library card receiving pocket. Still further, a pocket for receipt of a book marking card or book identifying card is provided as an auxiliary function of a spine reinforcing strip which extends for part or full length of the spine, being secured to the protective sheet at upper and lower edges.

Convex edges on the front and back pocket panels facilitate insertion of book covers into the protective cover pockets, and a book marking strip, scored to facilitate dividing the strip into a plurality of bookmarks, is secured to an upper edge of the cover sheet.

BRIEF DESCRIPTION OF THE DRAWINGS

FIG. 1 is a plan view of the inside of a protective cover embodying principles of the present invention prior to separation of the cover into primary and secondary panel sections;

FIG. 2 is a section taken on lines 2—2 of FIG. 1 employing the same horizontal (as viewed in FIG. 2) scale but employing a greatly enlarged vertical scale;

FIG. 3 is an exploded view of outside and inside panels prior to assembly and final cutting of outside edges;

FIG. 4 is a fragmented enlarged view showing a weld seam corner boundary detail;

FIG. 5 is a pictorial view, illustrating application of the protective cover to a book, and showing the beginning of separation of the secondary panel section;

FIG. 6 shows another intermediate step in the application of the protective cover to the book, showing the intermediate section severed from the primary section and inserted on the cover of the book;

FIG. 7 illustrates the final step in application of the protective cover to the book;

FIG. 8 illustrates insertion of a library card into a card receiving pocket formed in the front pocket panel;

FIG. 9 is a fragmentary enlarged vertical section of the front cover of FIG. 8, showing the card about to be inserted into the card pocket;

FIG. 10 illustrates the protective cover applied to a book and a book identifying library code strip about to be inserted into the spine pocket of the cover;

FIG. 11 is a section taken on line 11—11 of FIG. 10;

FIGS. 12 and 13 are enlarged fragmentary illustrations of first and second modifications of the spinal reinforcing strip of the protective cover; and FIG. 14 is a section taken on lines 13—13 of FIG. 12.

DETAILED DESCRIPTION

FIGS. 1 and 2 show an assembled protective cover embodying principles of the present invention, prior to separation of the primary and secondary sections, but otherwise fully assembled. FIG. 3 illustrates inside and outside panels used in a preferred form of manufacture of the cover of FIGS. 1 and 2, showing the two panels before assembly, welding and cutting. Details of the assembly process will be described below in connection with a detailed description of FIG. 3.

As illustrated in FIGS. 1, 2 and 3, a protector sheet or protective cove embodying principles of the present invention is formed of a single integral outside panel 10 made of a flexible and transparent plastic material having front and back side edges 12,14 and front and back book cover receiving pocket panels 16,18 secured to respective end portions of the cover. The outside panel 10 may be considered to have a front cover portion generally underlying the front pocket panel 16 and a back cover portion generally underlying the back pocket panel 18, with an intermediate spinal portion integral with and extending between the front and back cover portions. To a part of the intermediate spine portion is secured a spine reinforcing strip 22, which is secured solely at its upper and lower ends. Outside panel 10 has a deep score or v-shaped groove 24 formed in an outside surface thereof, and a strip of peel off adhesive 26 is secured to an inside surface of panel 10 closely adjacent the groove 24. Details of this groove and peel off adhesive strip combination, their structure, function and operation, are more particularly set forth in my prior patent No. 3,891,240.

Between separation groove 24 and back pocket edge 36 is positioned a bookmark strip 28, secured at its upper edge to the outside panel 10 along welding edge 60 and formed with a pair of deep score lines 30,32 to facilitate dividing the strip 38 into three separate bookmarks.

Each of the pocket panels 16 and 18 has an inwardly convexly curved free edge, such as edge 34 for panel 16 and edge 36 for panel 18. The pocket panels 16,18 are secured by any suitable means, as by adhesive, heat welding, or sewing, etc. around three peripheral edges thereof. Reinforcing strip 22 may be similarly secured by heat welded seams, such as seams 40 and 130 illustrated in FIG. 1.

An intermediate portion of the outside panel 10, generally between the free edges of pockets 16 and 18, has a decreased height (height of the cover is as measured in a vertical direction, as seen in FIG. 1), which is generally equal to the height of a book to be covered. This decreased height is provided by cutting out first and second strips along the top and bottom edges of the intermediate portions so that the height of the cover over the areas of the front and back pocket panels is greater than the height of the cover at its intermediate section. Thus the height of outside panel 10 over an intermediate portion thereof, as measured between an upper edge 44 and a lower edge 46, is less than the height of the panel, as measured between the upper and lower edges 48,50 and between upper and lower edges 52,56 over the area of the front and back pocket panels. The increased height portions merge with the decreased height intermediate portions by means of tapered edges 58,59,60 and 61, as can be seen in FIG. 1. Height of the cover over the area of the front pocket panel preferably is equal to height of the cover over the area of the back cover panel. Effectively, top and bottom edges of outside panel 10 are displaced inwardly by a distance substantially equal to the width of upper and lower edge weld seams that secure the pocket panels 16,18 to the outside panel 10, as will be described below.

Taper 58 and taper 59 extend from approximately the free end 34 of the front pocket panel to the upper and lower edges of one side of strip 22 Tapers 60,61 extend from approximately the free end 36 of back pocket panel 18 to the decreased height portion of the outside panel at about the score line 24, illustrated in dotted lines in FIG. 2.

Front pocket panel 16 is formed with an upwardly convex slit 63 that extends through the panel 16, but does not extend into or through the outside panel 10.

The described protective cover may be made by different procedures. For example, the panel 10 may be made integral as indicated, and the various pocket panels, reinforcing strip and bookmark and the like may be formed separately and then individually positioned and secured thereto. However, manufacture and assembly of the completed protective cover is preferably performed as suggested by the illustration of FIG. 3. Outside panel 10 is made as a first integral sheet having the score line 24 in the outer surface thereof. This score line divides the outside panel into a primary section 70 and a secondary section 72. Adhesive strip 26 is then adhered to the primary section 70 closely adjacent the score, but on the inside of the panel and extending for nearly the full height of the panel. The panel has peripheral edge portions including top and bottom edges 76,78 and front and side edges 80,82, which will be employed for welding the panel to the additional elements to be secured thereto. The drawing of FIG. 3 illustrates, by the dotted line along these edges, an area of a weld seam that will be made to secure the various elements to the outside panel, although, as will be described more particularly below, intermediate portions of the top and bottom edges will be cut away rather than welded to form the previously described outside panel intermediate sections of decreased height.

An inner panel 90 is formed of an integral sheet of plastic of the same material as used to form the outside panel 10 and is also provided with top, bottom, front and back edges having edge areas, indicated by the dotted lines in FIG. 3, over which weld seams will be performed, again with intermediate portions being cut away to provide the decreased height portions. The outside and inside panels 10 and 90 are each rectangular and are each of the same or substantially the same outside dimensions. Inside panel 90 is formed with a first cutout area 92 extending between upper and lower weld seam areas 94,96 (the inside panel is continuous along its top and bottom edges) and laterally between the free convex outer edge 34 of front pocket panel 16 and one edge 94 of reinforcing strip 22. A second cut out area 100, extending between the upper and lower weld seam areas 94 and 96, is cut from the panel 90 and extends laterally from a second edge 102 of reinforcing strip 22 to a first edge 104 of the bookmark strip 28. The latter is integral at its upper end with the inside panel 90 at the upper weld seam area 94. The lower end of the bookmark strip 28 is cut free of the lower weld seam area 96. A third cutout area 110 is cut from the inside panel 90, again extending for the full height of the panel between upper and lower weld seam areas 94,96 and laterally between the inwardly convex free edge 36 of back pocket panel 18 and the near edge of the bookmark strip 28. Thus inside panel 90 is a single integral piece, being continuous around upper and lower edges along the weld seam areas 94,96, but is formed integrally with all of the elements that are to be secured to the outside panel 10, such elements including front and back panel pocket panels 16,18, reinforcing strip 22 and bookmark 28, all of which are integrally formed with and properly positioned with respect to one another and with respect to the edges of the inside panel.

To assemble the protective cover, the inside panel 90 is placed directly upon and in registry with the outside panel 10 (the two are the same size, as stated above), and the two are secured together, as by heat welding or an equivalent process, to provide front and back weld seams 116,118 (see FIG. 1) an upper edge weld seam portion 120 extending from the seam 116 to the taper 58, a second upper weld seam portion 122 extending from the back weld seam 118 to taper 60, a first bottom weld seam portion 124 extending from the back weld seam 118 to taper 61, and a second bottom weld seam portion 126 extending from front edge weld seam 116 to the tapered portion 59. Thus the pocket panels 16 and 18 are heat welded to the outside panel along three edges thereof, leaving the outwardly convex edges 34,36 of the pocket panels free of any connection to outside panel 10.

At the same time that the weld seams 120,122,124 and 126 are made along the pocket panels, shorter and somewhat inwardly positioned weld seams, such as weld seam 40 and weld seam 130 at upper and lower edges, respectively, of the reinforcing strip 22, are formed to securely connect the strip at its upper and lower edges to the outside panel 10. All other remaining portions of strip 22, between its upper and lower end weld seams, are free of any connection with the outside panel 10. If deemed necessary or desirable, part or all of one or both side edges of the reinforcing strip 22 may be heat welded to the outside panel, either providing a spine pocket open only at one side or providing no spine pocket at all, as will be described below.

Simultaneously with the making of the various weld seams, or thereafter, if deemed necessary or desirable, intermediate portions of upper and lower edges of both inside and outside panels (e.g. intermediate portions of the weld seam areas) are cut out or severed along sloping portions 58,59,60 and 61 and along the decreased height upper and lower edges 44,46. When the upper and lower edge cutouts are made, the central portions of the inside panel 90, including reinforcing strip 22, are no longer connected to one another by the upper and lower or top and bottom weld seam strip areas 94,96, because these have been cut out between the pocket panels 16 and 18. However, the welded seam formed between the outside panel 10 and the pocket panels, reinforcing strip and bookmark strip now serve to hold these securely connected in the desired assembled relation, as shown in FIGS. 1 and 2.

In a presently preferred manufacturing process, the weld seams for pocket panels, reinforcing strip and book mark are all made by a single heated weld die of appropriate configuration (substantially conforming to the peripheral configuration of the finished protective cover). The de may have cutting edges suitably positioned to cut away upper and lower edges at intermediate parts of the panels.

In forming the weld seams at the upper and lower outside corners of pocket panels 16 and 18, the inner and outer boundaries of the weld seam corners are formed as more specifically shown in FIG. 4, which illustrates the junction of weld seam portion 120 and weld seam portion 116 at the outer upper corner of front pocket panel 16. The inside corner 140 of this weld seam is a sharp right angle, whereas the outside corner 142 is formed with a small radius, having a radius of curvature, for example, in the order of about 1/16th inch for a weld seam width of 1/16 inch. In general the outer boundary configuration is a portion of a circle whose diameter is twice the width of the weld seam. For longer, heavier books the outside corner boundary may have a diameter three times the width of the weld seam. Thus the protective cover is able to provide a much closer, custom fit to the covers of a book by use of a weld seam corner configuration in which the inner boundary has an inner radius of curvature that is substantially less than the outer radius of curvature of the outer boundary of the weld seam corner.

In use of the book cover, the primary section 70 of the outside panel is severed from the secondary section 72 along score line 24, and the primary section is then applied to the book by inserting the front cover 144 of the book into the pocket formed between the outside panel 10 and front pocket panel 16, as illustrated in FIG. 5. As shown in this figure, as an alternative method of use of the cover, instead of first severing the secondary section 72, the latter may be severed after the front cover of the book is inserted into the front pocket of the protective cover. Having severed the secondary section along score line 24 and completely inserted the front cover of the book into the front pocket of the protective cover, as shown in FIG. 6, the secondary section is inserted over the back cover of the book. The severed end portion of the primary section, after removal of the adhesive protective layer to expose the adhesive of adhesive strip 26, is pulled around the spine of the book and then secured by means of the adhesive 26 to the outside surface of the secondary section. This final step is illustrated or suggested in FIG. 7.

The spinal reinforcing strip 22 is positioned on the inside panel 90 at a position offset from the center and closer to the front pocket panel 16. This facilitates adjustment of the position of the secondary section of the outside panel 10 to accommodate a book of increased width. Preferably the reinforcing strip 22 is positioned so that its forward edge 98 is spaced from the inner edge of the front edge weld seam 116 by a distance somewhat less than the width of the cover of a book to be received. It is intended to make th width of reinforcing strip 22 somewhat larger than the average spinal thickness of a book to provide ample spinal reinforcement and protection.

FIGS. 8 and 9 illustrate the use of the library card pocket formed in the pocket panel 16. The upwardly convex slit 63 has a lower edge 150 and an upper edge 152 which may be readily spread apart, providing a relatively large opening to slidably receive an identifying card, such as a library card, date-due slip, advertising material, etc., as illustrated at 154 in FIGS. 8 and 9. The slit 63 may be cut with a chisel edged cutter blade (from the inside, before assembly to the outside panel) to provide a straight, perpendicular upper edge 152 and a downwardly and inwardly slanting lower edge 150 (see FIG. 9). The downwardly and inwardly slant-cut of the relaxed convex lower edge of slit 63 allows the lower edge 150 of the slit to be displaced more readily laterally or outwardly of the upper edge 152 when the upper portion of pocket panel 16 is pressed inwardly (by a user's finger) or is bent generally along a line, such as line 156 (FIG. 8), extending through the end points of the slit. When the pocket panel 16 is pressed inwardly or is bent about a line 156, even though such pressing or bending be but a very small amount, the mid portion of the lower edge 150 is displaced enough (see FIG. 9) from the mid portion of the upper edge 152 of the slit to allow a corner of the card 154 to be inserted, and thus facilitate insertion of the remainder of the card into the pocket formed between the pocket panel 16 and the outside panel 10. Generally the slit 63 is positioned above the lower edge of the pocket panel 16 by a distance that is less than or about three quarters of the full height of the card 154 that is to be inserted in the pocket. This enables the inserted card to have its lower edge stopped by the lower weld seam of the front pocket, and while the card upper end projects above the slit 63 to allow this upper end to be grasped by a user. It is understood that additional such easy-access pockets can be formed in the inside of back pocket 18 or for that matter also on the outside panels of the book cover, including the spine sections.

The same effect of easy opening produced by the upwardly convex edge and downwardly slant-cut edge 150 of the slit 6 is provided for the outwardly convex edges 34 and 36 of the pocket panels 16 and 18. Thus a very slight bending of the front or back portions of the protective book cover about a line extending between the end points of the free edges 34,36, will cause the mid portion of these edges to be displaced from the outside panel 10, and thereby facilitate inserting the cover of the book into the pocket. The convex edges 34,36 may be cut at a slant so that, at the edge, the outer surface of the pocket panel is spaced from the outside panel 10.

The cutaway portions of upper and lower edges at intermediate areas of the protective book cover provide a decreased height of this portion, as previously mentioned. As books and their covers are of generally standardized sizes, the protective cover may be made with its pockets 16 dimensioned to snugly receive the covers of the book. However, the pocket portions of the protector sheets, because of the required weld seams, such as seams 120 and 126, extend above and below the book itself. In accordance with one feature of the present invention, as described above, the intermediate portion of the protective cover between the pocket panels 16 and 18 is of decreased height, having no weld seams (except for short inwardly positioned seams 40, 130). The cutout portion of top and bottom edges of the protective cover is substantially equal to the width of one weld seam, which may be in the order of approximately 1/16th of an inch. Thus the height of the protective cover at the intermediate spine section, generally the area of reinforcing spine strip 22, is substantially equal to the height of the book at the spine section, and is less than the height of the protective cover at its pockets by about 1/8 of an inch, the total width of upper and lower weld seams. Therefore, upper and lower edges of the protective cover lie substantially in the plane of the upper edge of the book bindings, as can be seen in FIGS. 5, 6, 7 and 8.

This arrangement eliminates the projection of the book cover at the spine of the book beyond the book spine itself. Any projection of the protective cover at this point is so slight as to be negligible. Thus the protective cover will not be subject to wear, fraying and tearing at upper and lower edges of its spine section.

In removing a book having the protective cover of this invention from a shelf, the reader can place his finger on the top of the book pages at the spine, pressing downwardly at this point with a pressure directed against the book, its binding and pages, rather than against any free or unsupported edge of the protective cover that may protrude upwardly. Thus there is no tendency to pull on a projecting portion (there is no projecting portion) of the protective cover, which will wear considerably longer. Similarly, when replacing a book on a shelf or putting the book down on any hard surface, it is common to contact the surface with the back edge of the bottom of the book spine first and then tilt the book forwardly into position. Again, there is no significant projection of the spine portion of the protective cover of this invention beyond the bottom of the book spine, and thus the protective cover is less subject to wear and tear, and the book is more readily handled.

To further support, stiffen and strengthen the spinal section of the protective sheet, the reinforcing strip 22 is provided, welded to the upper and lower edges of the intermediate spine portion of outside panel 10 along weld seams 40 and 130 at the extreme upper and lower edges. Both vertical side edges of strip 22 are completely free, and thus a pocket is formed between the reinforcing strip 22 and the outside panel 10. This pocket may be employed (where the panel 10 is made of transparent material) to display desired library indicia. Such indicia may be printed on an elongated card, such as card 170 illustrated in FIG. 10, which has a width substantially equal to or slightly less than the width of the reinforcing strip 22 and a length slightly less than the distance between weld seams 40 and 130. Suitable markings (FIG. 7), which may be unique to a particular library or library coding system, may be marked on the card 170 and the latter simply slidably inserted into the pocket formed between the reinforcing strip 22 and the outer panel 10. Accordingly the reinforcing strip performs multiple functions, stiffening and strengthening the spine, and concomitantly form a card display pocket.

FIG. 11 illustrates the pocket 172 between reinforcing strip 22 and outer panel 10, without the card 170 inserted therein. Of course when a card, such as card 170, is used, still further stiffening and reinforcement of the spine section of the protective cover is achieved. For example, card 170 may be made of a relatively stiff, flexible material, thus providing greater strength an a total of three layers to this spinal section of the protective cover.

FIGS. 12, 13 and 14 illustrate variations of the reinforcing strip which still provide both spine reinforcement and identifying card holding capabilities. As illustrated in FIG. 12, the reinforcing strip, instead of extending the full length of the spinal section of the protective cover, may comprise relatively short upper and lower flaps 180,182 welded to the outer panel 10 at upper and lower edge weld seams 184,186 respectively. These flaps are relatively short, but because they are securely welded at the upper and lower edges thereof, will still provide significant stiffening of the upper and lower portions of the protective cover spinal section and will still provide a holding means, such as upper and lower slots 181,183 (FIG. 14) for a card, such as card 170 of FIG. 10. Such a card may simply have its upper and lower portions inserted between the short flaps 180,182 and the outer panel 10. Again the card itself may provide additional stiffening as it is held securely by the overlying flaps 180,182, and between the protective cover spine portion and the book spine. The flaps 180,182, as illustrated in FIG. 12, have their free lower and upper edges curved. It will be readily appreciated that these edges may be of any configuration. For example, as illustrated in FIG. 13, the flaps 186,188 have inner edges cut straight across, and thus provide a slightly larger area of overlapping of an inserted library code identifying card, such as card 170. It will be appreciated that many variations in the spinal reinforcing strip, whether strip 22 or 180,182, or flaps 186,188, may be employed without departing from principles of the present invention. For example, if one or more different cards 170, each of a length less than the full height of the book, are to be employed, the continuous full length reinforcing strip 122 of FIG. 10 may be transversely welded at one or more lines mutually spaced along the length of the strip 22 to provide two or more individual, separate spine pockets. Further, as mentioned above, one of the longitudinal edges of the strip 22 may be welded to the outside panel.

The bookmark strip 28, which is permanently secured to an upper edge of the primary section of outside panel 10, may be simply lifted over the back cover and pages of the book to be inserted between the pages as a bookmark. Moreover, the marker strip 28, because of its scores, may be separated into three (or more) different markers, which may be individually employed at different page locations. Use of such built-in markers will help to protect the books since book users are less likely to employ bulky harmful objects as markers.

The material of which the protective cover sheet is made may be a conventional vinyl plastic material, preferably transparent. Other materials that may be used include various types of plastics, such as polypropylene, polyester or polyethylene, etc. Appropriate markings, decoration, embossing, imprinting or application instructions may be formed on suitable portions of the protective cover, including particularly the back pocket panel 18. The panel pockets may be clear or opaque.

There has been described an improved protective book cover having various features which facilitate its use and provide increased protection. The sharp inner corners of the cover pockets enable the cover to be more closely fitted to the book. Moreover, this corner configuration may be used in many articles other than protective covers, where a pocket is formed for reception of a flat sheet like article having sharp rectangular corners. The slant-cut convex library card pocket slits and slant-cut convex edges of the book cover pockets provide instant opening and easy access. The recessed intermediate portion of the cover, having a significantly decreased height to match actual height of the book, prevents fraying of intermediate portion edges. Spinal reinforcement, whether full or partial length, provides the additional function of a library card or code indicia holder. The reinforcing strips 180,182,186 and 188 of FIGS. 12, 13 and 14 may be made considerably shorter than illustrated and may in fact be provided solely by upper and lower edge welded seams, or by a very short length of flap of about 1/16th of an inch. Such reinforcement still provides greater strength for the upper and lower edges of the spinal section and may provide a holding function for a properly sized library card. The protective cover is easy to manufacture, may be made in one standard size to fit books of many different widths, is convenient to use, has increased life and greater utility in library or other institutional use.

I claim:

1. A book protective cover for removable attachment to and detachment from a book having front and back covers, a spine and a number of bound pages, said protective cover comprising:

an outside panel having front and back side edges and top and bottom edges, said panel having a front cover portion, a back cover portion and an intermediate spine portion between the front and back cover portions, a front pocket panel secured to the front cover portion to define a front pocket for receiving the front cover of a book, a back pocket panel secured to the back cover portion to define a back pocket for receiving the back cover of a book, and spine reinforcing means secured to said intermediate spine portion at top and bottom edges of said outside panel, said spine reinforcing means extending inwardly for at least a distance from each of said top and bottom edges and cooperating with said spine portion to define a holder for an indicia bearing card positioned within the protective cover along said spine portion.

2. The protective cover of claim 1 wherein one of said pocket panels has first and second mutually spaced side edges and includes a card holding slit, said slit extending transversely across said one pocket panel between points spaced inwardly of said pocket panel side edges, said slit being convex upwardly, to provide an easy open lip that may be readily displaced outwardly of the plane of said one pocket panel to provide an opening for receiving a card inserted through said slit between said pocket panel and one of said front and back cover portions.

3. The protective cover of claim 1 wherein said spine reinforcing means comprises an elongated spine reinforcing strip extending between said top and bottom edges of said outside panel and having at least one side edge free of attachment to said outside panel, thereby defining an elongated pocket, open along at least one side, between said spine reinforcing strip and said spine portion.

4. The protective cover of claim 1 wherein said spine reinforcing means comprises a short reinforcing strip having an outer edge connected to the intermediate spine portion an having an inner edge free of attachment to said outside panel.

5. The protective cover of claim 1 including a bookmark strip having first and second ends and first and second side edges, said first end being secured to one of said top and bottom edges of said outside panel, said second end and said side edges of said bookmark strip being free of attachment to said outside panel.

6. The protective cover of claim 1 wherein said front and back pocket panels each has a free inner edge and has outer, top and bottom edges, a weld seam connecting said front and back pocket panels to said outside panel along said outer, top and bottom edges of said pocket panels said weld seam providing a clear space between inner edges of top and bottom edges of the panel to define a book cover receiving pocket having a height substantially equal to the height of a book cover to be received in said receiving pocket, said outside panel having a portion between said front and back panels having a height substantially equal to said height of a book cover and less than the height of said outside panel along top and bottom edges of said pocket panels.

7. The protective cover of claim 1 wherein said outside panel has a first height at said front and back pocket panels between top and bottom edges thereof, that is greater than the height of the cover of a book to be received in said pockets, and wherein said outside panel has a height at said intermediate spine portion that is less than said first height.

8. The protective cover of claim 1 including top and bottom weld seams between top and bottom edges of said outside panel and said front and back pocket panels, said outside panel having a first height at said pocket panels including said weld seams, and having a second height at said intermediate spine portion that is less than said first height, whereby said second height is substantially equal to the height of a book cover received in one of the front and back covers, and said first height exceeds said second height by approximately the width of top and bottom weld seams.

9. The protective cover of claim 1 wherein said outside panel has a first height at said front and back cover portions, and has a second height at said intermediate spine portion, said second height being less than said first height.

10. The protective cover of claim 1 wherein said back cover portion includes a return portion integral with said first cover and spine portions, and further includes a secondary section adhesively connected to said return portion.

11. A book protective cover for removable attachment to and detachment from a book having front and back covers, a spine and a number of bound pages, said protective cover comprising:

an outside panel having front and back side edges and top and bottom edges, said panel having a front cover portion, a back cover portion and an intermediate spine portion between the front and back cover portions, a front pocket panel secured to the front cover portion at front, top and bottom edges to define a front pocket for receiving the front cover of a book, and having a height between said top and bottom edges sufficient to accommodate a back cover of a book, and a back pocket panel secured to the back cover portion to define a back pocket for receiving the back cover of a book, and said outside panel having a reduced height at said intermediate spine portion that is less than the height of said front and back pocket panels and less than the height of said outside panel at said front and back cover portion.

12. The protective cover of claim 11 wherein top and bottom edges of said outside panel are cut away to provide said reduced height.

13. The protective cover of claim 11 wherein said front and back pocket panels are secured to top and bottom edges of front and back cover portions of said outside panel by a seam having a small width, said intermediate spine portion of said outside panel having top and bottom edges thereof displaced inwardly by a distance substantially equal to said seam width to provide said reduced height.

14. The protective cover of claim 11 wherein said outside panel has a first height at said front and back pocket panels between top and bottom edges thereof, that is greater than the height of the cover of a book to be received in said pockets, and wherein said outside panel has a height at said intermediate spine portion that is less than said first height.

15. The protective cover of claim 11 including top and bottom weld seams between top and bottom edges of said outside panel and said front and back pocket panels, said outside panel having a first height at said pocket panels including said weld seams, and having a second height at said intermediate spine portion that is less than said first height by an amount approximately equal to combined width of said top and bottom weld seams, whereby said second height is substantially equal to the height of a book cover received in one of the front and back covers.

16. The protective cover of claim 11 wherein said outside panel has a first height at said front and back cover portions, and has a second height at said intermediate spine portion, said second height being less than said first height.

17. The protective cover of claim 11 wherein said front and back pocket panels each has a free inner edge and has outer, top and bottom edges, a weld seam connecting said front and back pocket panels to said outside panel along said outer, top and bottom edges of said pocket panels, said weld seam providing a clear space between inner edges of top and bottom portions thereof to define a book cover receiving pocket having a height substantially equal to the height of a book cover to be received in said receiving pocket, said outside panel intermediate portion having a height substantially equal to said height of a book cove and less than the height of said outside panel along top and bottom edges of said pocket panels.

18. The protective cover of claim 11 including spine reinforcing means secured to said intermediate spine portion at top and bottom edges of said outside panel, said spine reinforcing means extending inwardly for at least a distance from each of said top and bottom edges and cooperating with said spine portion to define a holder for an indicia bearing card that may be positioned within the protective cover along said spine portion.

19. The protective cover of claim 11 including spine reinforcing means comprising an elongated spine reinforcing strip extending between said top and bottom edges of said outside panel and having at least one side edge free of attachment to said outside panel, thereby defining an elongated pocket, open along at least one side, between said spine reinforcing strip and said spine portion.

20. The protective cover of claim 11 including spine reinforcing means comprising a short reinforcing strip having an outer edge connected to the intermediate spine portion and having an inner edge free of attachment to said outside panel.

21. The protective cover of claim 11 wherein one of said pocket panels has first and second mutually spaced side edges and includes a card holding slit, said slit extending transversely across said one pocket panel between points spaced inwardly of said pocket panel side edges, said slit being convex upwardly, to provide an easy open lip that may be readily displaced outwardly of the plane of said one pocket panel to provide an opening for receiving a card inserted through said slit between said pocket panel and one of said front and back cover portions.

22. The protective cover of claim 11 wherein said outside panel is substantially rectangular and has a plurality of panel corners, and wherein said pocket panels are secured to said cover portions by weld seams extending along said front and back side edges and top and bottom edges, said weld seams forming seam corners at said panel corners, at least some of said seam corners having inner and outer boundaries, said outer boundary having an outer radius of curvature, said inner boundary having an inner radius of curvature substantially less than said outer radius of curvature and forming a sharp, rectangular inner seam corner.

23. The protective cover of claim 21 wherein said slit has one edge cut at a slant to provide a downwardly and inwardly slanting lower edge to facilitate outward displacement of said easy open lip.

24. A book protective cover for removable attachment to and detachment from a book having front and back covers, a spine and a number of bound pages, said protective cover comprising:

an outside panel having front and back side edges and top and bottom edges, said panel having a front cover portion, a back cover portion and an intermediate spine portion between the front and back cover portions, a front pocket panel secured to the front cover portion to define a front pocket for receiving the front cover of a book, and a back pocket panel secured to the back cover portion to define a back pocket for receiving the back cover of a book, one of said pocket panels having first and second mutually spaced side edges, and a card holding slit, said slit extending transversely across said one pocket panel between points spaced inwardly of said pocket panel side edges, said slit being convex upwardly, to provide an easy open lip that may be readily displaced outwardly of the plane of said one pocket panel to provide an opening for receiving a card inserted through said slit between said pocket panel and one of said front and back cover portions.

25. A book protective cover for removable attachment to and detachment from a book having front and back covers, a spine and a number of bound pages, said protective cover comprising:

an outside panel having front and back side edges and top and bottom edges, said panel having a front cover portion, a back cover portion and an intermediate spine portion between the front and back cover portions, a front pocket panel secured to the front cover portion to define a front pocket for receiving the front cover of a book, and a back pocket panel secured to the back cover portion to define a back pocket for receiving the back cover of a book said outside panel being substantially rectangular and having a plurality of panel corners, said pocket panels being secured to said cover portions by weld seams extending along said front and back side edges and top and bottom edges, said weld seams forming seam corners at said panel corners, at least some of said seam corners having inner and outer boundaries, said outer boundary having an outer radius of curvature, said inner boundary having an inner radius of curvature substantially less than said outer radius of curvature and forming a sharp, rectangular inner seam corner.

26. A plastic receptacle for a flat sheet like article having rectangular corners comprising:

a first panel having first and second side edges and top and bottom edges and having a plurality of panel corners, a pocket panel secured to the first panel to cooperate therewith to define a pocket for receiving a flat sheet like article, said pocket panel being secured to said first panel by weld seams extending along said first and second side edges and top and bottom edges, said weld seams forming seam corners at said panel corners, at least some of said seam corners having inner and outer boundaries, said outer boundary having an outer radius of curvature, said inner boundary having an inner radius of curvature substantially less than said outer radius of curvature and forming a sharp, rectangular inner seam corner.

* * * *. *